US006550452B2

(12) United States Patent
Schneider

(10) Patent No.: US 6,550,452 B2
(45) Date of Patent: Apr. 22, 2003

(54) METHOD OF IDENTIFYING THE IGNITION STROKE IN THE CASE OF A SINGLE-CYLINDER FOUR STROKE ENGINE

(75) Inventor: Juergen Schneider, Dachau (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 7 days.

(21) Appl. No.: 09/820,317

(22) Filed: Mar. 29, 2001

(65) Prior Publication Data

US 2001/0025625 A1 Oct. 4, 2001

(30) Foreign Application Priority Data

Mar. 29, 2000 (DE) ..... 100 15 595

(51) Int. Cl.[7] ..... F02D 41/34; F02D 43/00

(52) U.S. Cl. ..... 123/436; 701/113; 701/114; 73/116

(58) Field of Search ..... 123/436, 491, 123/179.5; 701/113, 114; 73/116

(56) References Cited

U.S. PATENT DOCUMENTS 4,870,587 A * 9/1989 Kumagai ..... 701/110
5,562,082 A * 10/1996 Norppa et al. ..... 123/406.53

FOREIGN PATENT DOCUMENTS

| | | | | |
|---|---|---|---|---|
| DE | 44 18 577 A1 | | 5/1994 | |
| DE | 195 40 675 C1 | | 10/1995 | |
| DE | 198 10 214 A1 | | 3/1998 | |
| DE | 198 44 910 A1 | | 9/1998 | |
| JP | 08074652 A | | 3/1996 | |
| JP | 2000-337206 A | * | 12/2000 | ..... F02D/45/00 |

* cited by examiner

*Primary Examiner*—Andrew M. Dolinar
(74) *Attorney, Agent, or Firm*—Crowell & Moring LLP

(57) ABSTRACT

In a method of recognizing the ignition stroke in a single-cylinder four-stroke engine, the position and the angular speed of the crankshaft are determined. The period duration is measured from the top of dead center to a defined angle of rotation of the crankshaft, and the measured period durations of two successive revolutions of the crankshaft are compared. The ignition stroke takes place during the rotation of the crankshaft having the shorter period duration.

5 Claims, 1 Drawing Sheet

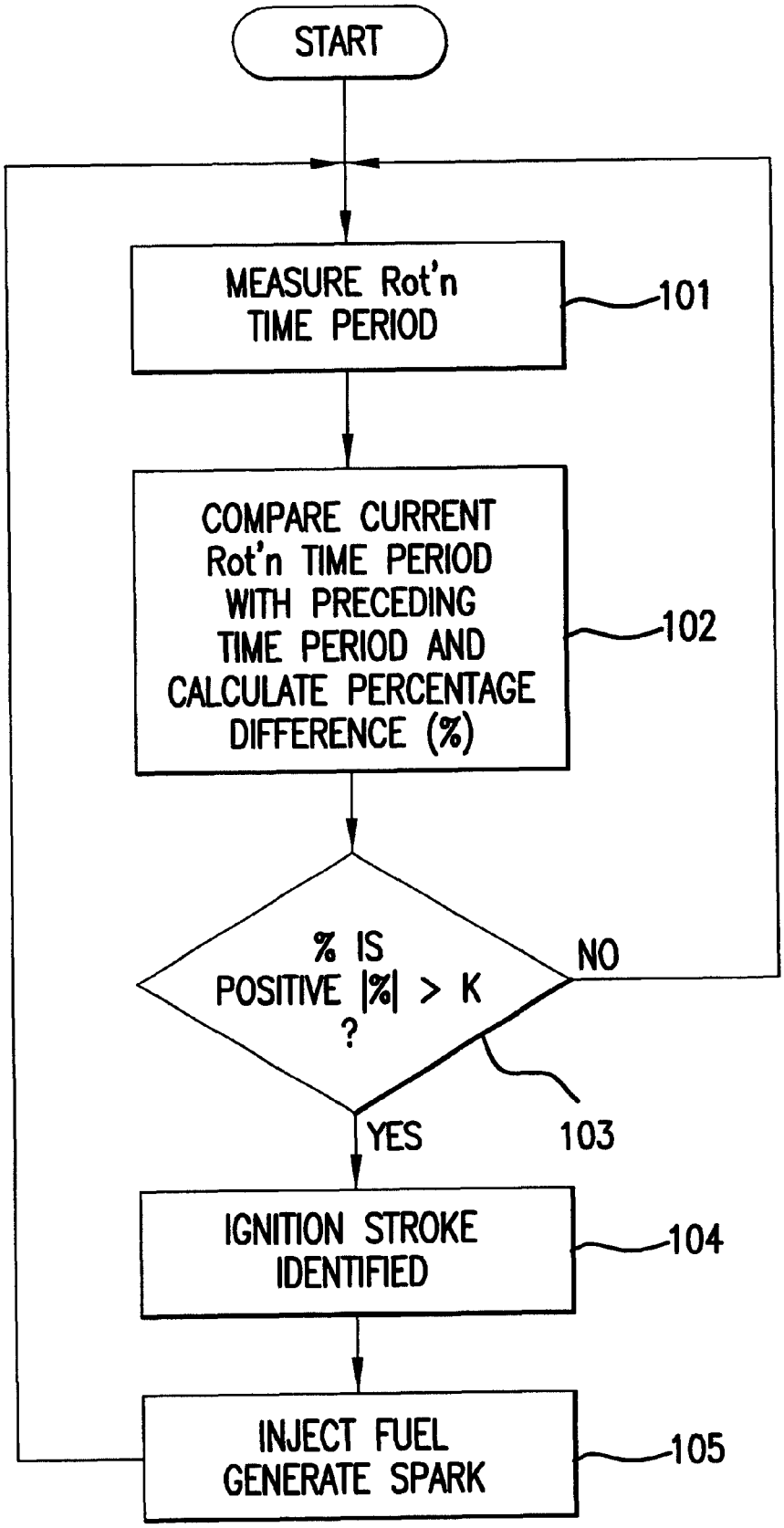
START
MEASURE Rot'n TIME PERIOD
101
COMPARE CURRENT Rot'n TIME PERIOD WITH PRECEDING TIME PERIOD AND CALCULATE PERCENTAGE DIFFERENCE (%)
102
% IS POSITIVE |%| > K ?
NO
YES
103
IGNITION STROKE IDENTIFIED
104
INJECT FUEL GENERATE SPARK
105

METHOD OF IDENTIFYING THE IGNITION STROKE IN THE CASE OF A SINGLE-CYLINDER FOUR STROKE ENGINE

BACKGROUND AND SUMMARY OF THE INVENTION

This application claims the priority of German patent document 100 15 592.2, filed Mar. 29, 2000, the disclosure of which is expressly incorporated by reference herein.

The invention relates to a method of identifying the ignition stroke in a single-cylinder four-stroke engine, in which the position and the angular speed of the crankshaft are determined.

In a four-stroke engine, the induction stroke and the compression stroke, on the one hand, and the power or ignition stroke and the exhaust stroke, on the other hand, take place in successive revolutions of the crankshaft. In a carburetor engine, fuel is fed in the induction stroke together with the combustion air as soon as the intake valve opens, which is controlled by the camshaft. In contrast, in the case of an injection engine, the fuel is injected into the cylinder just before the start of the power stroke; that is, just before the piston reaches the top of dead center. In case, the recognition of the correct point in time for the injection of fuel represents a particular problem. Although, by measuring the position and the angular speed of the crankshaft, the correct point in time for the injection of the fuel prior to the ignition stroke can be determined, it cannot be determined in particular whether the crankshaft is carrying out that revolution in which the ignition stroke takes place.

Four-stroke engines are known in which fuel is injected into the cylinder during each revolution of the crankshaft, just before the piston reaches the top of dead center, and the spark plug is ignited once during each revolution of the crankshaft. This means that, during each second revolution of the crankshaft, fuel is injected at the wrong point in time and an ignition spark is generated, specifically during that revolution of the crankshaft in which the induction stroke takes place. Such an approach results in an increased burning-off of the spark plug and increased current consumption, which in turn can lead to problems with respect to the charge balance. However, it is a more serious disadvantage that very poor exhaust gas values occur because the establishing angle of the injection pulses cannot be emitted synchronously with the stroke.

Because the camshaft rotates at half the angular speed of the crankshaft, it could easily be used to determine during which of two successive revolutions of the crankshaft the ignition stroke is taking place. However, for this purpose, an additional sensor would have to be assigned to the camshaft to determine its position. This requires additional costs, and the accommodation of the generator wheel on the camshaft and of the pertaining sensor presents problems because of the limited available space.

It is an object of the invention to provide a method of the initially mentioned type which, without using a separate sensor to determine the position of the camshaft, permits the determination of that revolution (of two successive revolutions of the crankshaft) in which the ignition stroke takes place.

This and other objects and advantages are achieved by the method according to the invention, in which the time period from the top of dead center to a defined angle of rotation of the crankshaft is measured, and the measured periods of two successive revolutions are compared. The ignition stroke occurs during the revolution of the crankshaft with the shorter period duration.

The invention is based on the recognition that the angular speed of the crankshaft of a single-cylinder four-stroke engine is nonuniform. During the ignition stroke in particular, an accelerating force acts upon the crankshaft, while, during the exhaust, induction and compression stroke, a braking force acts upon the crankshaft by way of the piston and the connecting rod. Because of the resulting different angular speeds of the crankshaft, the period duration, that is, the time duration required for the rotation of the crankshaft about a defined angle of rotation during two successive revolutions of the crankshaft, will differ. By measuring and comparing the period durations of two successive revolutions of the crankshaft, it can therefore be determined definitively during which of the two revolutions of the crankshaft the ignition stroke is taking place.

The period duration is preferably measured from the top of dead center to the bottom of dead center of the crankshaft because, in this range, the largest differences occur with respect to the angular speed of the crankshaft. The difference between the measured period durations of two successive revolutions of the crankshaft is therefore particularly large and clear.

Since, during the measuring of the period durations, disturbance variables are superimposed, the measuring of the periods is expediently filtered. In this case, a different filtering time constant is used during the starting operation than during the normal operation of the engine.

In comparison to a conventional four-stroke injection engine, in which fuel is injected and an ignition spark is generated during each revolution of the crankshaft, the method according to the invention has the advantage that the useful life of the spark plug is doubled because only half the number of ignition sparks is generated. As a result of the reduced energy requirement of the ignition coil, the generator can be smaller and less expensive. In addition, the crude emissions are reduced because the fuel is injected correctly with respect to its phase, so that a less expensive (coating) catalyst can be used. This is achieved without the use of a sensor to determine the position of the camshaft, and the revolution of the crankshaft in which the ignition stroke is takes place is identified.

Other objects, advantages and novel features of the present invention will become apparent from the following detailed description of the invention when considered in conjunction with the accompanying drawings.

BRIEF DESCRIPTION OF THE DRAWINGS

The single FIGURE of the drawing shows a block diagram of the method according to the invention for identifying the ignition stroke in a four cycle engine.

DETAILED DESCRIPTION OF THE DRAWINGS

When the engine is started, the position of the crankshaft is determined first, and fuel is injected during each revolution. As soon as the engine runs independently and has a nonuniform angular speed because of the forces to be accelerated or braked by the piston by way of the connecting rod, it can clearly be determined in which of the two successive revolutions of the crankshaft the ignition stroke is taking place. Based on this information, fuel can be injected and an ignition spark generated only during each second revolution.

During the ignition stroke, the crankshaft is accelerated by the ignition. During the subsequent induction stroke (360° later), this acceleration does not take place. For calculating this acceleration, the period duration is measured from the top of dead center (OT) to the bottom of dead center (UT) of the crankshaft (Step 101 in the FIGURE). By comparing the period durations of two respective successive revolutions, it is determined during which rotation the ignition stroke or the induction stroke is taking place (Step 102). The measurement of the period durations is appropriately filtered, during the starting operation a different filtering time constant being used than in the normal engine operation. As a result, the influence of the starter on the measuring of the period duration is minimized.

For determining the ignition stroke, the difference between the period durations of two successive revolutions is calculated in percentages, as indicated in Step 102. The preceding sign of this percentage value is a measurement of the respectively slower or faster rotation. If the absolute value of the percentage difference exceeds a threshold value stored in the memory of a corresponding control unit (Step 103), the ignition stroke is recognized (Step 104), and the injection pulses as well as the ignitions can be emitted correctly to the ignition stroke (Step 105). The recognition of the threshold value is carried out as a function of the temperature in the starting range of the engine in order to compensate for different frictional losses in the case of a warm and a cold engine. During normal operation of the engine, the recognition of the threshold value takes place in a load or rotational speed range (characteristic diagram) in order to ensure a secure recognition of the ignition stroke in each operating point of the engine. A diagnostic function monitors the correct recognition.

A person skilled in the art is familiar with the construction of a device for determining the position, that is, of the angle of rotation, of the crankshaft and for determining the duration of a defined period of the crankshaft, so that a detailed explanation is not required. The determined measuring results are processed in an engine control unit in order to ensure that fuel is injected into the cylinder in the correct amount and at the correct point in time and the ignition takes place at the correct point in time.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method of recognizing the ignition stroke in a four-stroke engine, comprising:

detecting position of an engine crankshaft;

during each revolution of the crankshaft, measuring a period duration for rotation through a defined angle of rotation of the crankshaft between first and second predetermined angular positions;

comparing measured period durations of successive revolutions of the crankshaft; and identifying the revolution having shorter measured period duration as the revolution during which the ignition stroke takes place.

2. The method according to claim 1, wherein the period durations are measured from top of dead center to bottom of dead center of the crankshaft.

3. The method according to claim 1, wherein measurement of the period duration is filtered; and during a starting operation, a different filtering time constant is used than during normal operation of the engine.

4. The method according to claim 1, wherein a threshold value for recognizing a period duration difference in percent in the normal operation of the engine is a function of an engine operating point.

5. The method according to claim 1, wherein recognition of the ignition stroke is permanently monitored by a diagnostic function.

* * * * *